US007222713B2

(12) United States Patent
Hauer et al.

(10) Patent No.: US 7,222,713 B2
(45) Date of Patent: May 29, 2007

(54) STEP ATTACHMENT ON THE STEP CHAIN OF AN ESCALATOR

(75) Inventors: Uwe Hauer, Nienburg (DE); Andreas Stuffel, Porta Westfalica (DE); Helmut J. W. Meyer, Bueckeburg (DE); Richard N. Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 395 days.

(21) Appl. No.: 10/432,646

(22) PCT Filed: Nov. 15, 2001

(86) PCT No.: PCT/US01/44983

§ 371 (c)(1),
(2), (4) Date: May 23, 2003

(87) PCT Pub. No.: WO02/44070

PCT Pub. Date: Jun. 6, 2002

(65) Prior Publication Data

US 2004/0060800 A1 Apr. 1, 2004

(30) Foreign Application Priority Data

May 25, 2001 (DE) ..... 101 25 686

(51) Int. Cl.
*B66B 23/12* (2006.01)

(52) U.S. Cl. ..... 198/333; 198/327

(58) Field of Classification Search ..... 198/326, 198/327, 333

See application file for complete search history.

(56) References Cited

U.S. PATENT DOCUMENTS

| | | | | |
|---|---|---|---|---|
| 3,789,972 | A * | 2/1974 | Kraft | 198/330 |
| 3,986,595 | A | 10/1976 | Asano et al. | |
| 4,470,497 | A | 9/1984 | Kraft | |
| 4,519,490 | A | 5/1985 | White | |
| 4,569,433 | A * | 2/1986 | Ishida et al. | 198/333 |
| 4,638,901 | A | 1/1987 | Lunardi | |
| 4,726,463 | A | 2/1988 | Babler | |
| 4,746,000 | A * | 5/1988 | Nakatani et al. | 198/328 |
| 5,242,042 | A | 9/1993 | Mauldin | |
| 5,560,468 | A | 10/1996 | Inoue | |
| 5,695,040 | A * | 12/1997 | Watanabe et al. | 198/333 |
| 6,213,278 | B1 | 4/2001 | Tanigawa | |
| 6,450,316 | B1 * | 9/2002 | Stuffel et al. | 198/326 |
| 6,868,956 | B2 * | 3/2005 | Hauer et al. | 198/333 |

FOREIGN PATENT DOCUMENTS

| | | |
|---|---|---|
| DE | 2346266 A | 3/1975 |
| DE | 199 25 399 A1 | 12/1999 |

* cited by examiner

*Primary Examiner*—Mark A. Deuble
(74) *Attorney, Agent, or Firm*—Carlson, Gaskey & Olds

(57) ABSTRACT

The invention pertains to an escalator (2) with an endless stair band (6) that is composed of several interconnected steps (4), wherein a step (4) contains a walking surface (16) and a front side (18) and is connected to respective lateral step chains (8) that are driven around a lower and an upper reversing point (22) by means of a drive, and wherein a step (4) contains at least one step roller (34) that is guided by a step roller guide. The invention is characterized by the fact that the point (32) at which a step (4) is fastened to the step chain (8) is arranged in the vicinity of the front side (18) of the step (4).

20 Claims, 3 Drawing Sheets

STEP ATTACHMENT ON THE STEP CHAIN OF AN ESCALATOR

Figure 1:
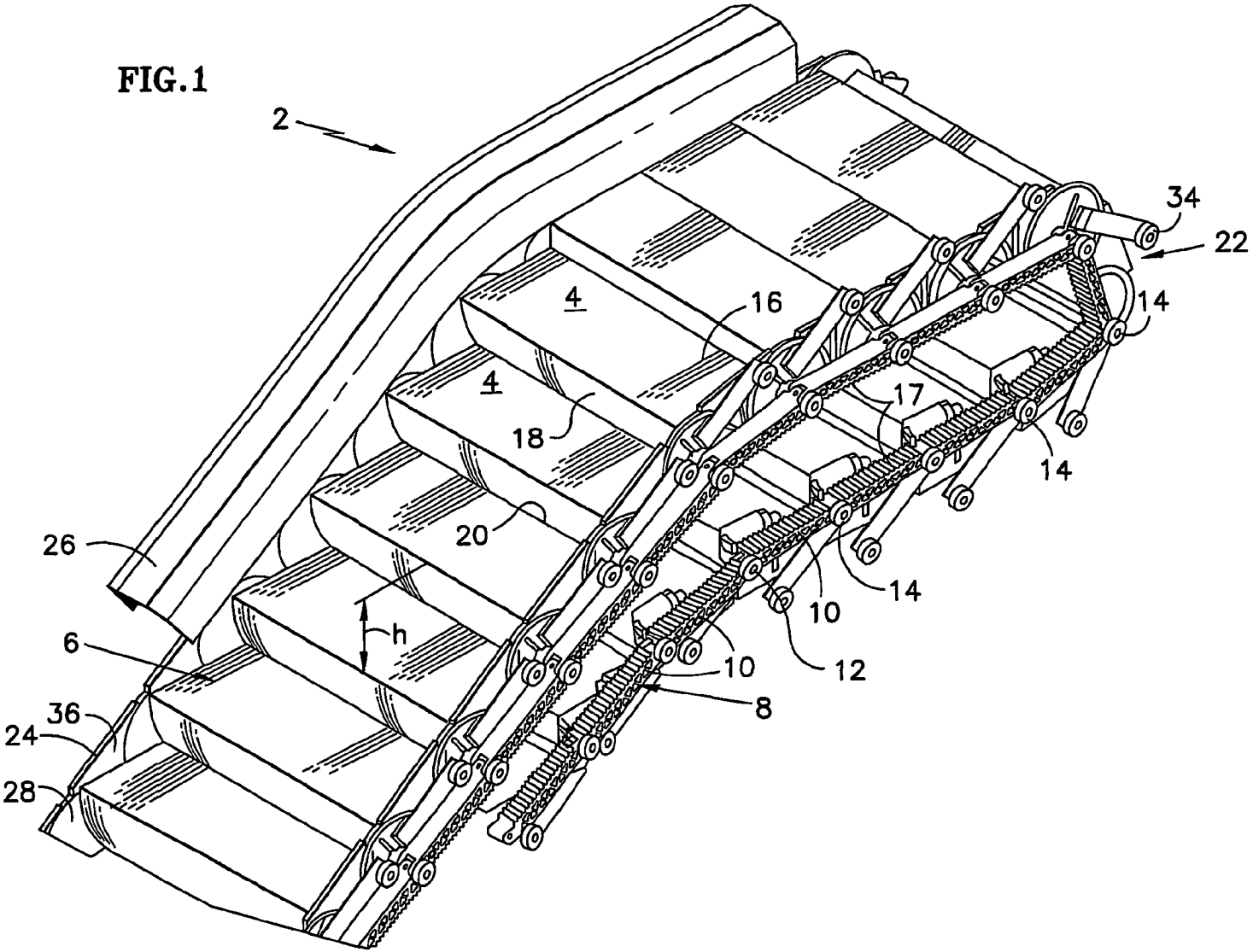

The present invention pertains to an escalator with an endless stair band that is composed of several interconnected steps, wherein a step contains a walking surface and a front side and is connected to respective lateral step chains that are driven around a lower and an upper reversing point by means of a drive, and wherein a step contains at least one step roller that is guided by a step roller guide.

Numerous escalators of this type are in operation. The reversing points are typically realized in the form of a chain reversing wheel or a pair of chain reversing wheels, around which the two laterally arranged step chains of the stair band are guided and driven. There also exist escalators in which propulsion of the step chains does not take place in the vicinity of the reversal points, but rather in, for example, the forward moving section or the backward moving section. In escalators of this type, a reversing plate or an essentially semicircular guideway is, for example, provided instead of the chain reversing wheel, wherein the reversing plate or the guideway respectively follows the guideways of the step chain rollers, and wherein the step chain rollers are reversed from the forward moving section into the backward moving section of the passenger conveyor in the reversing plate or the guideway. In this respect, the term reversing point is intended to cover all types of constructions, e.g., chain reversing wheels, reversing guideways or reversing plates.

The steps of an escalator typically consists of essentially box-shaped elements with a walking surface that is also referred to as the "tread" and a front side that is exposed in the inclined region of the escalator and referred to as the "riser." The remaining sides of the box, which are never exposed to the passengers during operation of the escalator, may also be closed, but frequently remain open. This applies, in particular, to the underside of the step which is situated opposite to the walling surface and to the rear side of the step. The side walls of the step which are directed toward the step chain are typically arranged regularly for structural reasons. In instances in which a rear wall of the box-like step element is not provided opposite to the front side, the side walls of the box which are directed toward the step chains frequently have a triangular shape that is tapered toward the bottom, and the step itself has only a relatively small thickness in its rear region, by comparison to the thickness of the step in the vicinity of the front side. The weight and the material requirement can be significantly reduced due to these measures.

The steps are typically fastened to the step chains by means of a step axle. The step axle usually extends through the step body and is connected to the step chains with both of its free ends. The attachment point of a step on a step chain is generally situated at the back end of the step opposite to the front side and, as mentioned above, is usually not particularly thick. The step is customarily manufactured from a material that can be easily processed, for example, a material that can be extruded such as aluminum, an aluminum alloy, or a plastic. The step axle is manufactured from a stronger material, for example, iron or steel. The step axle is fastened to the step by means of suitable attachment arrangements provided on the back end of the step. In order to detach the step from the step chain as is frequently required for maintenance purposes, the step axle needs to be removed from the step and from the step chains. It is common practice to remove the step from the step axle. Since such a detachment makes it necessary to gain access to the step axle from the rear side of the step opposite to the walking surface of the step, a step can be detached in the reversing region with a reasonable expenditure of effort only at a location at which the distance between two steps is great enough that maintenance personnel can gain access with both hands and remove the step from the step axle. In the maintenance of escalators, various situations arise in which a displacement of the stair band for detaching a step is impossible or undesirable. Consequently, it has been continuously attempted to modify the construction of escalators in such a way that a step can be detached at any arbitrary point in the forward moving section with a relatively low expenditure [of effort]. As mentioned above, the step is relatively thin at its back end. This means that alternative constructions for attachment of the step to the step chain that would allow the detachment of a step from the step chain at any position can scarcely be realized for space reasons.

An entirely different problem of escalators pertains to the safety of escalators and the prevention of accidents. In an escalator, the individual steps typically move in a very narrow "channel" that is laterally limited by panel elements that are referred to as the "skirt boards." These skirt boards are rigidly arranged to the frame of the escalator, with the steps moving relative to this skirt board. The gap between the steps and the skirt board needs to be kept very small for safety reasons, so as to reliably ensure that no objects or body parts of passengers are pulled into this gap and become trapped therein. The requirement to ensure a very narrow gap is associated with a high maintenance expenditure. In certain instances, it is entirely impossible to fulfill the safety requirements with respect to a narrow gap. One option for lowering this risk potential, other than with a narrow gap, consists of providing a bottom panel that moves with the steps. Such a movable bottom panel is, for example, described in U.S. Pat. No. 4,470,497. Such bottom panels according to the prior art have either the disadvantage that they project relatively far upward beyond the walking surface of the step in the horizontal regions of the escalator, e.g., at the entry point and the exit point, or that they have a relatively complicated design.

Consequently, the present invention is based on the objective of making available an escalator, the construction of which is realized such that sufficient space for laterally attachment the step to the step chains is available on the side wall of the steps, namely in the region in which the steps are fastened to the step chain, and that a bottom panel which moves with the steps can be realized without the above-mentioned disadvantages.

In an escalator of the initially described type, this objective is, according to the present invention, attained due to the fact that the point at which a step is fastened to a step chain is arranged in the vicinity of the front side of the step. In comparison to the prior art in which the step is fastened to a step chain in the vicinity of the back end of the step, the invention proposes an entirely contrary solution. If one follows the movement of a step over the course of an upwardly transporting escalator from the lower entry point to the upper exit point, the steps emerge underneath the comb plate at the entry point in an essentially horizontal position. The walking surfaces of the individual steps are essentially situated in one plane at this location. From this horizontal region, the movement path of the steps gradually transforms into an inclined movement path in a lower transition region and then back into a horizontal movement path in an upper transition region, in which the steps ultimately disappear underneath the comb plate at the exit point. The walking surfaces of the individual steps maintain a horizontal position over this entire exposed movement path. This means that only the horizontal distance between the walking surfaces of adjacent steps increases from zero at start to a maximum distance in the inclined region of the movement path, and then decreases again to essentially zero. The step roller that is guided by the step roller guide controls the correct horizontal position of the walking surface of the step.

According to the prior art, the front end of the walking surface situated on the front side of the step is gradually raised above the walking surface of the adjacent lower step in the lower transition region. Analogously, this front end of the step is lowered again in the upper transition region until it is situated at essentially the same height as the adjacent step. The present invention proposes an entirely different arrangement in which the front end is "held in position" while the back end of the step opposite to the front side is guided by the step roller such that it "sinks" below the level of the walking surface of the adjacent higher step in the lower transition region. Analogously, the back end "rises" in the upper transition region. In this movement sequence, a movable bottom panel can be realized relatively easily, with said bottom panel containing flanges that are laterally fastened on the steps and practically do not protrude upward beyond the walking surface in a region in which the stair band essentially extends horizontally.

The point at which the step is fastened to the side wall is, according to the invention, arranged in a side wall region in which the side wall has a relatively large surface, such that sufficient space is available for realizing an alternative attachment arrangement for the step on the step chain, namely an attachment arrangement in which a step can be relatively easily detached at any arbitrary point of the exposed stair band section.

It is preferred to arrange a step roller at the back end of the step, i.e., at the end opposite to the front side of the step. This results in a relatively long lever arm for the step roller, such that a stable, reliable and precise guidance of the step in the stair band is achieved.

Lateral flange elements which form part of a bottom panel that moves with the step during operation of the escalator are preferably connected to the steps. In one particularly preferred embodiment, these flange elements are realized in a shape similar to a segment of a circle, with their center being arranged on the rotational axis of the step relative to the step chain. The flange elements may, for example, be realized integrally with the step. Alternatively, they may also be separably or rigidly fastened to the step.

The step roller is preferably guided by the step guide in such a way that one step is displaced relative to an adjacent step during operation of the escalator, namely from a position in which the walking surfaces of the two steps essentially lie in one plane to a position in which the walking surfaces are offset relative to one another by a height h. In this case, the attachment point lies in the vicinity of the front side and is essentially arranged on the step front side such that it is offset downward, relative to the walking surface of this step, essentially by the height h. This design is preferred because a sufficient surface for realizing a special embodiment of the attachment arrangement is available on the side wall of a step above the attachment point. This design is also preferred because a quite compact construction of the escalator can be achieved, in particular, in connection with a step roller that is arranged above the walking surface.

Alternatively, the attachment point is preferably arranged in the vicinity of the front side of the step, slightly underneath the walking surface. The term "slightly underneath" the walking surface refers to an attachment point that is essentially situated below the upper side of the walking surface by no more than half the height h. It is preferred to choose a distance that corresponds to one quarter of the height h or less.

The step roller is preferably connected to the step in such a way that is arranged above the walking surface. As mentioned above, this arrangement of the step roller is particularly advantageous in connection with an attachment point that is offset downward from the walking surface by essentially the height h. In addition to the compact construction thus realized, another advantage with respect to a simple detachment of the step is achieved with this arrangement of the step roller above the walking surface of the step. When removing the balustrade panel in order to detach a step at any arbitrary point of the transport path, the step roller is also easily accessible. This may, under certain circumstances, present problems if the step roller is situated underneath the walking surface. In such instances, the step roller is typically situated underneath the point at which the step is fastened to the step chain, and consequently underneath the step chain guide. This makes detachment significantly more difficult.

The step roller is preferably connected to the step with an attachment arm. The attachment arm may either be mounted on the step in the form of a separate component or be manufactured together with the step in the form of an integral component, for example, by means of an injection molding process.

The step roller is preferably connected to the step in such a way that is arranged beneath the walking surface. With respect to geometric considerations, this arrangement is preferred for instances in which the attachment point lies slightly underneath the walking surface of the step. The step roller may in this case also be connected to the step with an attachment arm.

Figure 2:
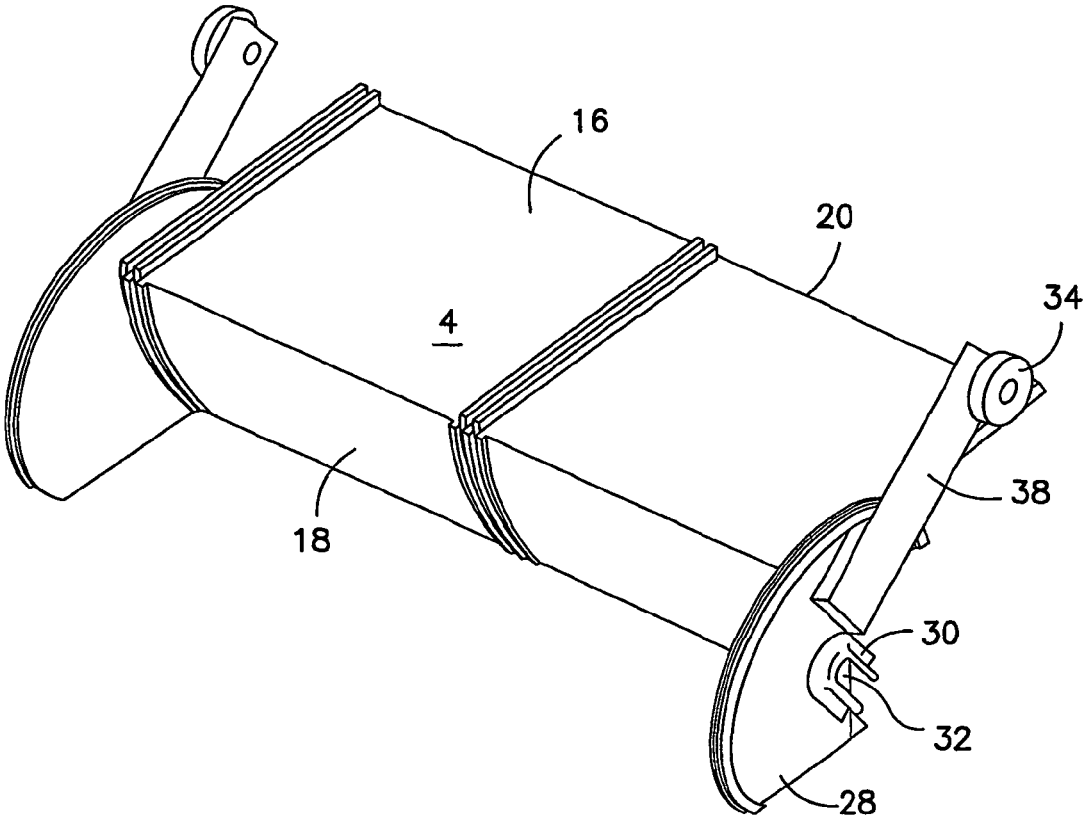
Figure 4:
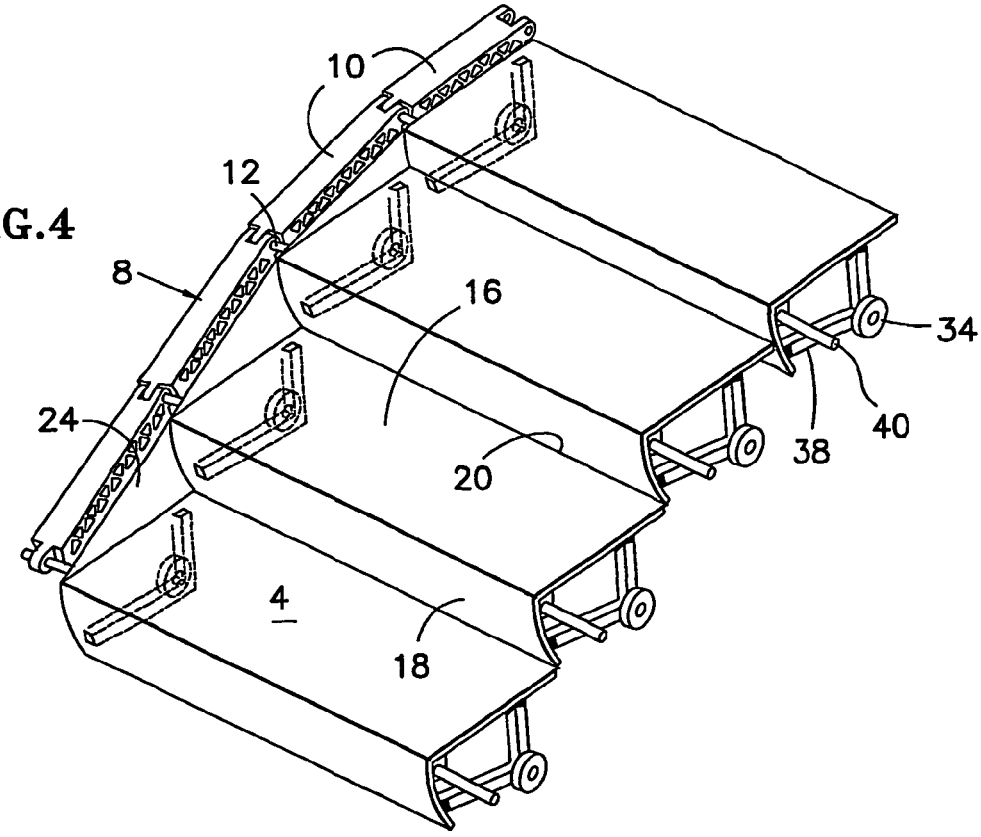
Figure 3:
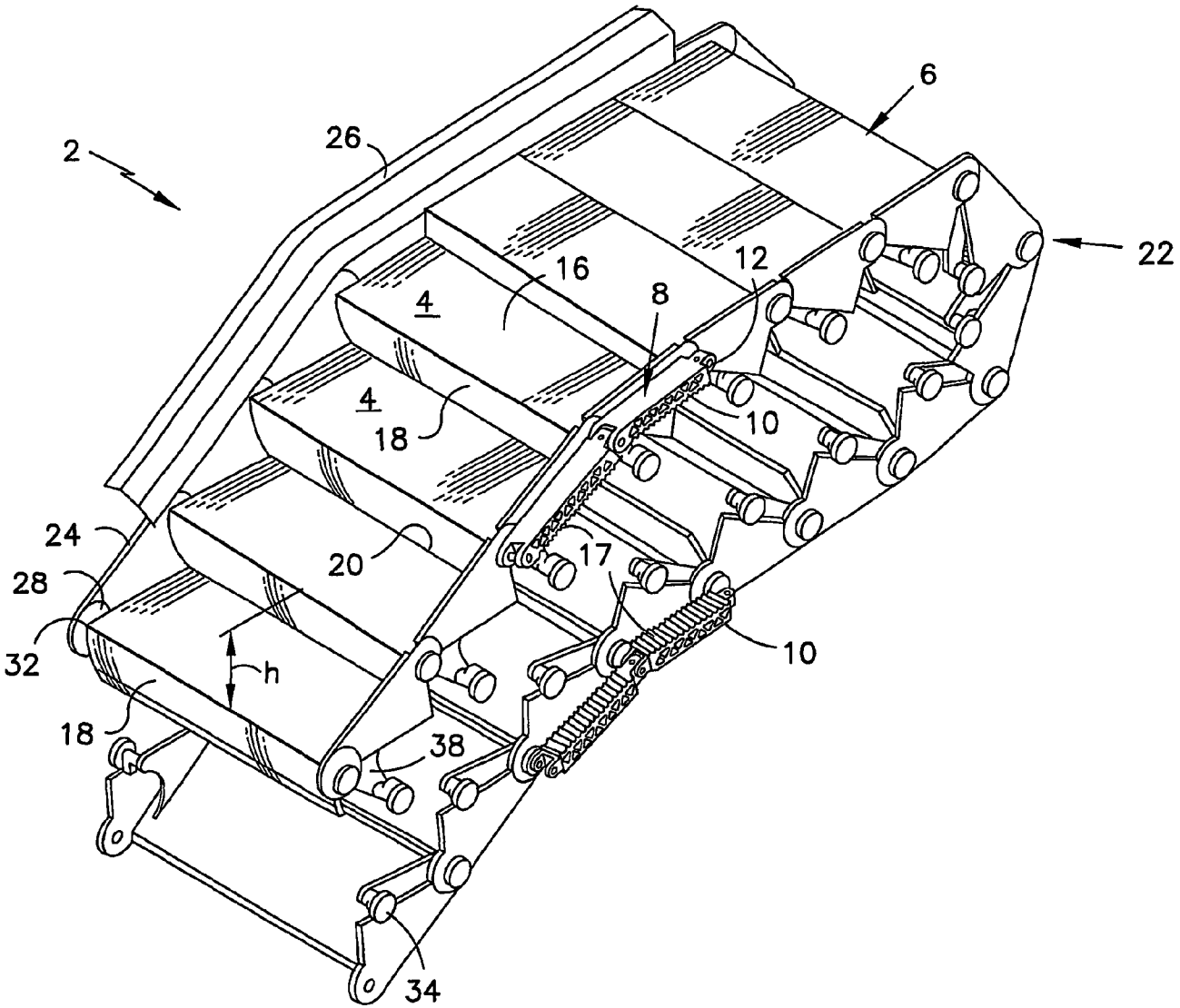

The invention, as well as preferred embodiments of the invention, are described in greater detail below with reference to the figures. The figures show:

FIG. 1, part of an escalator according to the invention;

FIG. 2, a step of the escalator according to FIG. 1;

FIG. 3, an alternative embodiment of an escalator according to the invention, and FIG. 4, an alternative variation of the embodiment according to FIG. 3.

FIG. 1 shows an escalator 2 with an endless stair band 6 that is composed of several interconnected steps 4. The steps 4 are respectively connected to transport chains 8 arranged laterally thereof. The term "laterally" connected to the steps 4 includes embodiments in which the transport or step chains 8 are, if seen in a top view, arranged laterally adjacent to the steps 4, as well as embodiments in which the step chains 8 are, if seen in a top view, arranged laterally underneath the walking surface 16 of a step 4. The transport chains 8 are composed of a series of chain links 10. The chain links 10 are connected to one another at the pivots 12. Step chain rollers 14 that guide the step chain 8 along the closed continuous path in (not-shown) step chain guides are also arranged on these pivots 12.

The escalator 2 is driven by a (not-shown) linear drive that is realized with an endless, revolving toothed drive belt. The toothing of the toothed drive belt meshes with the toothing 16 of the chain links 10. The linear drive is preferably arranged in a region of the escalator 2 which has a constant inclination.

FIG. 1 also shows that a step 4 contains a walking surface or "tread" 16 and a front side or "riser" 18. A back end 20 of the step 4 is arranged on the step 4 opposite to the front side 18. One can also ascertain that a height difference h exists between the walking surface 16 of a step 4 and the walking surface 16 of the adjacent lower step 4 in the region of the escalator 2 which has a constant inclination. With respect to the three steps 4 of the stair band 6 which are arranged on the upper right side, the walking surfaces 16 of these steps essentially lie in one plane. The reversing point 22 is situated to the right thereof.

FIG. 1 also shows the bottom panel 24 that moves with the steps, as well as a balustrade panel 26 that covers the top of the bottom panel 24 and continues upward. A balustrade, for example, of glass may be arranged on the panel 26, with a (not-shown) hand rail revolving on said balustrade essentially synchronously with the stair band 6.

FIG. 2 shows a single step 4. One can see the walking surface 16, the front side 18 and the back end 20. One can also ascertain lateral attachment flanges 28 that form part of the moving bottom panel 24. An attachment element 30 for connecting the step 4 to the step chain 8 is situated in the center of the segment-like flanges 28. The attachment element 30 is realized similarly to a pocket-shaped receptacle. The attachment point 32 of the step 4, about which said step can be turned, is situated in the center of this attachment element 30. A corresponding bolt-like attachment element of the step chain 8, which preferably contains a thickening on its end, is able to engage into the pocket-like attachment element 30. This arrangement may be realized in the form of a ball bearing that is pressed onto a bolt stub and held in the pocket-like receptacle by its outer race. A securing element may be arranged such that the outer race is held in a locked position and released in an unlocked position. This type of construction makes it possible to very easily separate the step 4 from the step chain 8 on one side after removing part of the balustrade. This means that the step 4 can be relatively easily detached at any arbitrary point of the transport path. FIG. 2 also shows the step roller 34 that is guided in a (not-shown) step roller guide.

FIG. 1 indicates that the moving bottom panel 24 is composed of the flange elements 28 and of essentially triangular intermediate elements 36. The flange elements 28 and the intermediate elements 36 may, for example, engage into one another, like in a tongue-and-groove connection, and consequently be guided such that they are able to move relative to one another. Instead of providing a balustrade panel 26 that projects over and overlaps the moving bottom panel, it would also be conceivable to choose a panel that is situated directly adjacent to the moving bottom panel. A connection similar to a tongue-and-groove connection between the stationary panel and the moving bottom panel may also be chosen for this purpose.

FIG. 2 also indicates that the attachment point 32 is clearly situated underneath the walking surface 16 of the step 4, and by essentially the height h. This figure also shows an attachment arm 38 that projects upward beyond the walking surface 16 of the step 4, and on which a step roller 34 is rotatably arranged.

FIG. 3 shows an alternative variation of the embodiment according to FIG. 1. In this figure, corresponding elements and characteristics are identified by the same reference symbols as in FIGS. 1 and 2. To that extent, the explanations regarding these figures also apply to FIG. 3 and to FIG. 4. In the embodiment according to FIG. 3, the attachment point 32 is arranged slightly underneath the walking surface of a step 4. However, the attachment point may also be arranged slightly above this walking surface. One can also see a step roller 34 that is arranged on an arm 38. The moving bottom panel 24 merely contains flange elements 28 that are arranged on the step chain 8 or are rotatably arranged on the steps 4. Analogously to FIG. 1, this figure also shows that the moving bottom panel 24 is essentially situated underneath the level of the walking surface 16 in the upper horizontal region of the stair band 6.

FIG. 4 shows an alternative variation of the escalator 2 according to FIG. 3. In this case, the attachment point 32 is also situated slightly underneath the walking surface 16 of the step. This attachment arrangement is, in particular, realized in the form of a continuous step axle 40. One can also see the step roller 34 that lies underneath the walking surface 16 and is arranged on a structural frame of the step 4.

The invention claimed is:

1. A step for use in a passenger conveyor, comprising:

a tread surface having a forward edge and a rear edge;

a riser surface extending away from the forward edge of the tread surface;

at least one sidewall near a lateral edge of and remaining in a fixed position relative to the tread surface, the sidewall extending beyond at least one of the tread surface or the riser surface such that the sidewall is at least one of above the tread surface or forward of the forward edge and the riser surface;

at least one support arm having at least a portion that is generally parallel to the at least one sidewall and a distal end spaced from the sidewall and above a plane containing the tread surface; and a guide roller supported by the support arm near the distal end such that the guide roller is above the plane containing the tread surface.

2. The step of claim 1, comprising an attachment for attaching the step to a step chain adapted to move the step in a desired direction, the attachment being positioned closer to the forward edge of the tread surface than the rear edge.

3. The step of claim 2, wherein the attachment is forward of the riser.

4. The step of claim 2, wherein the attachment is supported by the at least one sidewall.

5. The step of claim 2, wherein the attachment is below a plane containing the tread surface.

6. The step of claim 1, wherein the at least one support arm has one end supported on the at least one sidewall.

7. The step of claim 1, wherein the guide roller is closer to the rear edge of the tread surface than the forward edge.

8. A step for use in a passenger conveyor, comprising:

a tread surface having a forward edge and a rear edge;

a riser surface extending away from the forward edge of the tread surface;

at least one sidewall near a lateral edge of and remaining in a fixed position relative to the tread surface, the sidewall extending beyond a plane containing at least one of the tread surface or the riser surface; and an attachment for attaching the step to a step chain adapted to move the step in a desired direction, the attachment being positioned closer to the forward edge of the tread surface than the rear edge.

9. The step of claim 8, wherein the attachment is forward of the riser.

10. The step of claim 8, wherein the attachment is supported by the at least one sidewall.

11. The step of claim 8, wherein the attachment is below a plane containing the tread surface.

12. The step of claim 8, comprising at least one support arm having at least a portion that is generally parallel to the at least one sidewall and a distal end above a plane containing the tread surface; and a guide roller supported by the support arm near the distal end such that the guide roller is above the plane containing the tread surface.

13. The step of claim 12, wherein the at least one support arm has one end supported on the at least one sidewall.

14. The step of claim 12, wherein the guide roller is closer to the rear edge of the tread surface than the forward edge.

15. A passenger conveyor, comprising:

a plurality of steps;

a step chain associated with the steps for moving the steps in a desired direction;

each step comprising a tread surface having a forward edge and a rear edge;

a riser surface extending away from the forward edge of the tread surface;

at least one sidewall near a lateral edge of and remaining in a fixed position relative to the tread surface, the sidewall extending beyond a plane containing at least one of the tread surface or the riser surface; and an attachment for attaching the corresponding step to the step chain, the attachment being positioned closer to the forward edge of the tread surface than the rear edge.

16. The passenger conveyor of claim 15, wherein each said attachment is forward of the riser of the corresponding step.

17. The passenger conveyor of claim 15, wherein the attachment is supported at least partially on the corresponding at least one sidewall.

18. The passenger conveyor of claim 15, wherein the attachment is below a plane containing the tread surface.

19. The passenger conveyor of claim 18, wherein the tread surfaces of adjacent ones of the plurality of steps are displaced relative to each other up to a maximum displacement height during movement of the step chain and the steps and wherein each attachment is spaced from the plane containing the corresponding tread surface by a distance that is no more than one-half the maximum displacement distance.

20. The passenger conveyor of claim 18, wherein the tread surfaces of adjacent ones of the plurality of steps are displaced relative to each other up from a first position where the adjacent tread surfaces are essentially coplanar to a second position in which the tread surfaces are offset relative to each other by a height and wherein each attachment is spaced from the plane containing the corresponding tread surface by a distance that is approximately equal to the height.

* * * * *